US005295596A

United States Patent [19]

Squitieri

[11] Patent Number: 5,295,596

[45] Date of Patent: Mar. 22, 1994

[54] IN-STORE DISPLAY HAVING VARIABLE WIDTH

[75] Inventor: Anthony C. Squitieri, Norwalk, Conn.

[73] Assignee: Mechtronics Corporation, Stamford, Conn.

[21] Appl. No.: 894,456

[22] Filed: Jun. 5, 1992

[51] Int. Cl.[5] ..... A47F 5/00

[52] U.S. Cl. ..... 211/175; 211/43; 211/184

[58] Field of Search ..... 211/43, 175, 88, 184

[56] References Cited

U.S. PATENT DOCUMENTS

| | | | |
|---|---|---|---|
| 779,262 | 1/1905 | Burke | 211/43 X |
| 934,148 | 9/1909 | Duff | 211/43 |
| 1,682,060 | 8/1928 | Banks | 211/43 |
| 2,294,595 | 9/1942 | Dice | 211/43 |
| 2,545,844 | 3/1951 | Cougias | 211/43 |
| 4,106,735 | 8/1978 | Partain et al. | 211/43 X |
| 4,535,896 | 8/1985 | Evenson | 211/43 X |
| 4,938,365 | 7/1990 | Conway et al. | 211/175 X |

FOREIGN PATENT DOCUMENTS

| | | | |
|---|---|---|---|
| 401 | of 1859 | United Kingdom | 211/43 |

*Primary Examiner*—David A. Scherbel
*Assistant Examiner*—Derek J. Berger
*Attorney, Agent, or Firm*—Haynes N. Johnson

[57] ABSTRACT

An expandable display including a central member and two end pieces, the central member including fingers extending laterally from each side, the end pieces each having fingers extending laterally towards the central member, the fingers of the end pieces slidingly engaging the fingers of the central member, permitting the width of the display to be varied by relative sliding movement between the central member fingers and the end piece fingers. Each of the end pieces may include a hinged back for receiving and holding a display card. The central member may include a clamp at the rear for securing the display to another structure.

8 Claims, 8 Drawing Sheets

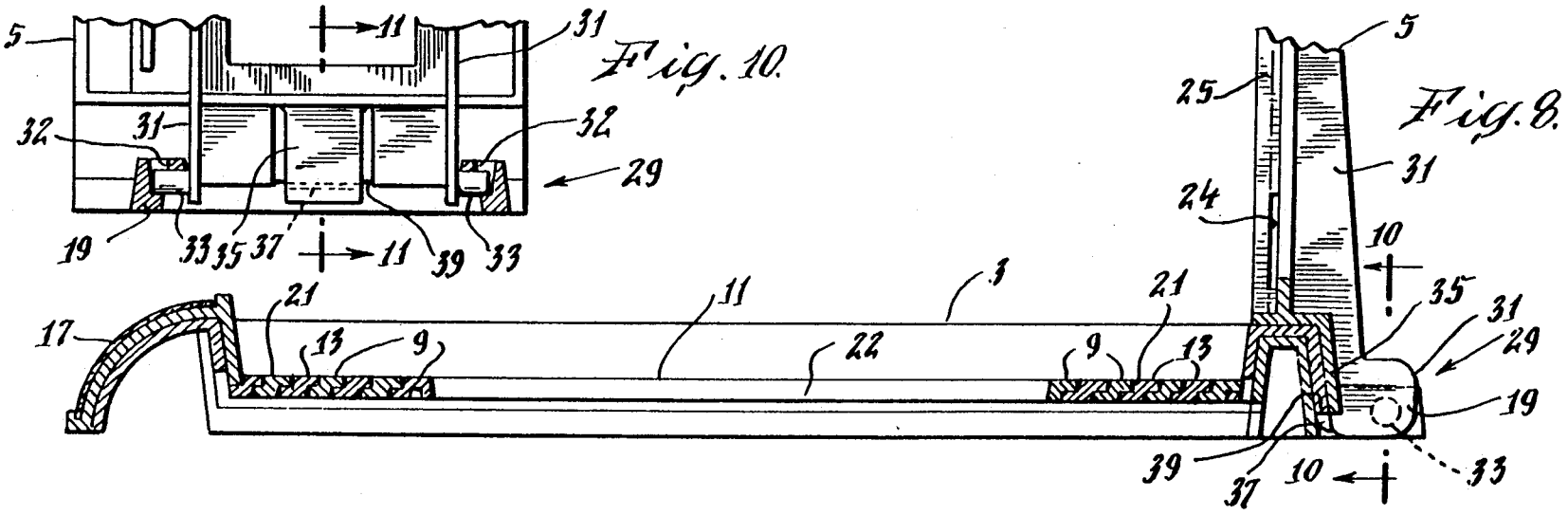
Fig. 8.
Fig. 10.
5
31
10
35
29
19
33
25
24
37
39
21
13
9
1
22
11
32
17
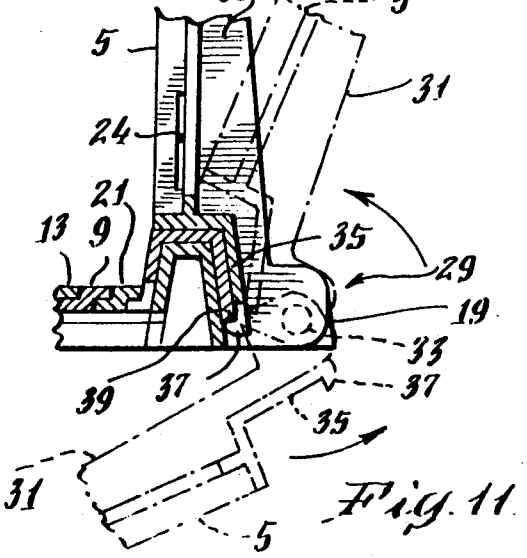
Fig. 11.
5
31
29
19
35
37
24
21
9
13
39
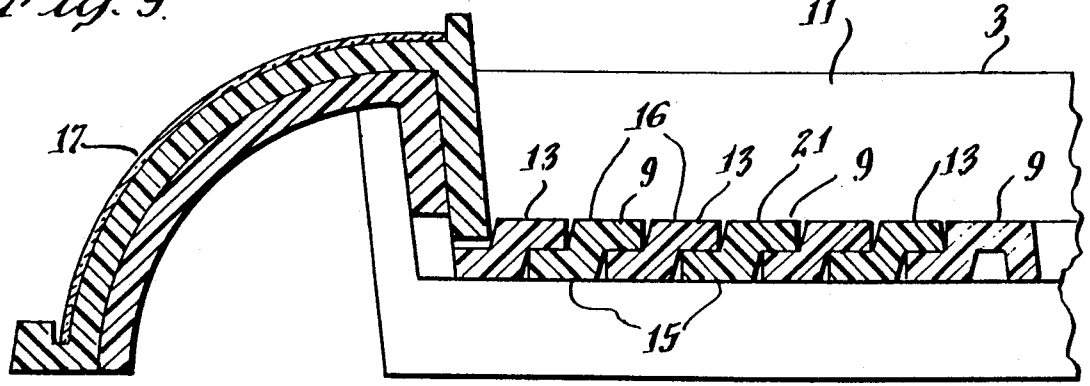
Fig. 9.
3
9
13
11
21
16
15
17

IN-STORE DISPLAY HAVING VARIABLE WIDTH

FIELD OF THE INVENTION

This invention relates to point-of-purchase displays of the type that are usually found on a store counter or associated with open shelving in the store. In particular, it relates to displays which can be varied in width to suit the store's needs at a particular time.

BACKGROUND OF THE INVENTION

Retail stores use various means for displaying goods, one kind being the display which is placed on the top of a counter to be readily seen by a customer. Countertop space is, of course, limited, and the dealer has to ration it in accordance with his judgment as to the amount of counter space he wishes to use for a particular product or line of products.

My invention permits the dealer to adjust the width of a given unit. Thus, the dealer can own fewer displays and adjust their width as desired, obviating the need for buying and storing a series of displays of different widths.

BRIEF SUMMARY OF THE INVENTION

My display has a base of variable width with a back to hold a display card, the back also being of variable width.

The base is formed essentially of three pieces, a central member having a series of laterally extending fingers on each side, with slots in between the fingers, and two end pieces with fingers projecting laterally toward the central member. The fingers of the end pieces are dimensioned to fit within the slots between the fingers of the central member; and the width of the base is determined by the extent that they are in the slots. The base will be narrow if the fingers are all the way in the slots, and wider if they project only partially into them.

The slots and fingers are of relatively narrow width so that the space produced by a slot is not so wide that product carried by the base would fall within a slot. Alternatively, the fingers can be located only at the front and back of the base, with a gap in the middle, the interengaging fingers being used primarily to provide structural strength to the base. In this a tray-like merchandise holder is supported by the central member and end pieces.

The back edges of the two end pieces each have hinged backs adapted to carry display cards. Thus, when the width of the base is great, the backs are farther apart, allowing for a larger display card. And, conversely, when the width of the base is narrow, the backs are closer together, calling for a narrower display card.

Each back is hinged to one of the end pieces, permitting shipment of a folded unit; but, when raised, they are held in their upright position by locking detents.

In a modification, the extendable base by itself is adapted to be secured to the end of a bank of shelves, to provide more shelf space Due to the adjustability of the shelf, it can be made to be the same length as the depth of the shelves themselves. In this instance, the bank of shelves can act as a display device.

If desired, either the base for the display or the shelf can be made of two slidingly interengagable end pieces, eliminating the central member.

DESCRIPTION OF THE DRAWINGS

FIG. 8 is a section taken on line 8-8 of FIG. 4, showing the interengagement of the fingers of the base sections and the locked hinge supporting the back section.

FIG. 9 is a an enlarged section of FIG. 8, taken near the front of the base, showing the finger interengagement.

FIG. 10 is a section taken on line 10-10 of FIG. 8 showing the structure of the hinges joining the base of the display with its back.

FIG. 11 is a section taken on line 11-11 of FIG. 10, showing the construction and operation of the hinges which hold the back section in place. It shows different positions for the hinges in dotted outline.

DETAILED DESCRIPTION OF THE INVENTION

Figure 1:
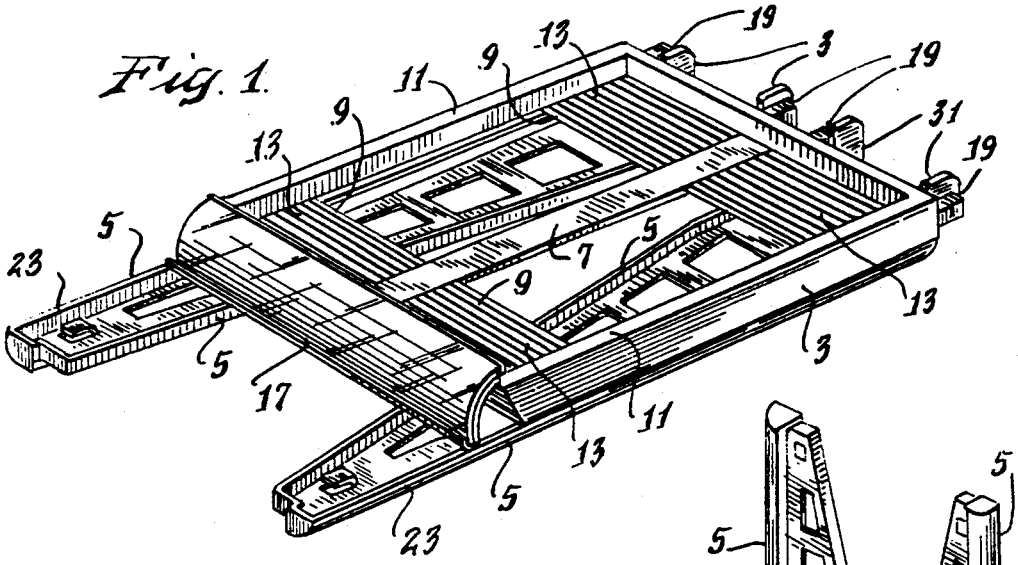
FIG. 1 is a perspective view of my display stand folded as it would be during shipment or when being stored.
Figure 2:
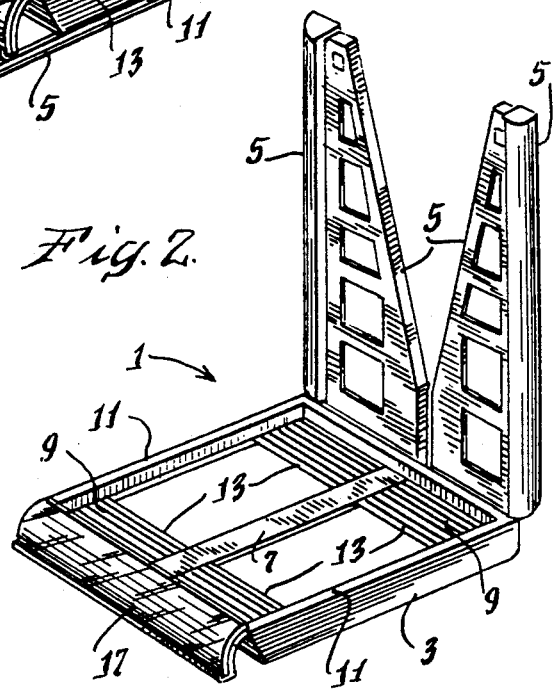
FIG. 2 is a perspective view of the stand, assembled, except for the display card, and in its narrow configuration.
Figure 3:
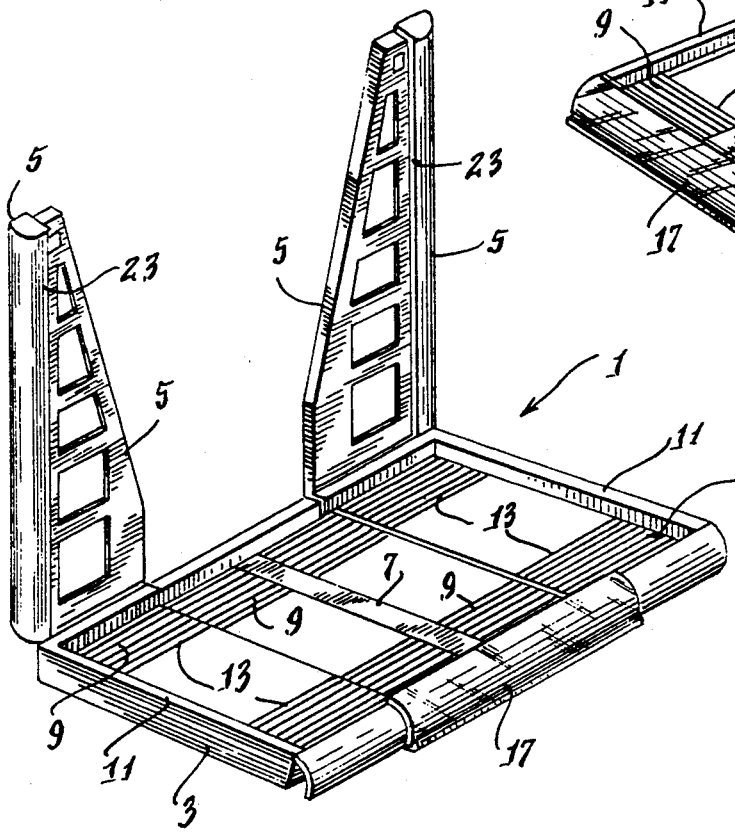
FIG. 3 is similar to FIG. 2, except that the stand is now in its expanded, wide configuration. It is, however, the same stand as that of FIG. 2.
Figure 4:
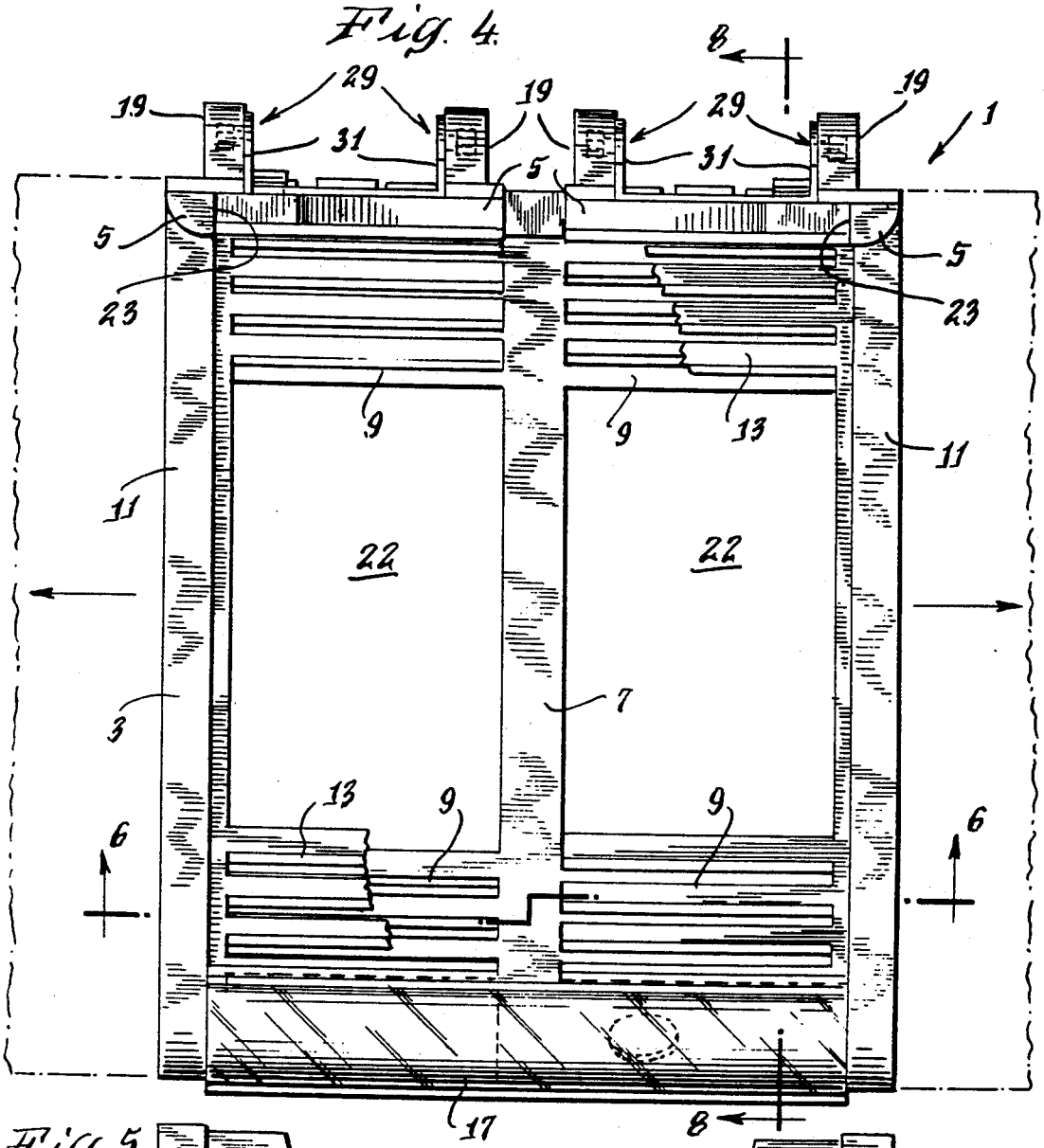
FIG. 4 is a plan view, partly in section of the base of my display stand.
Figure 5:
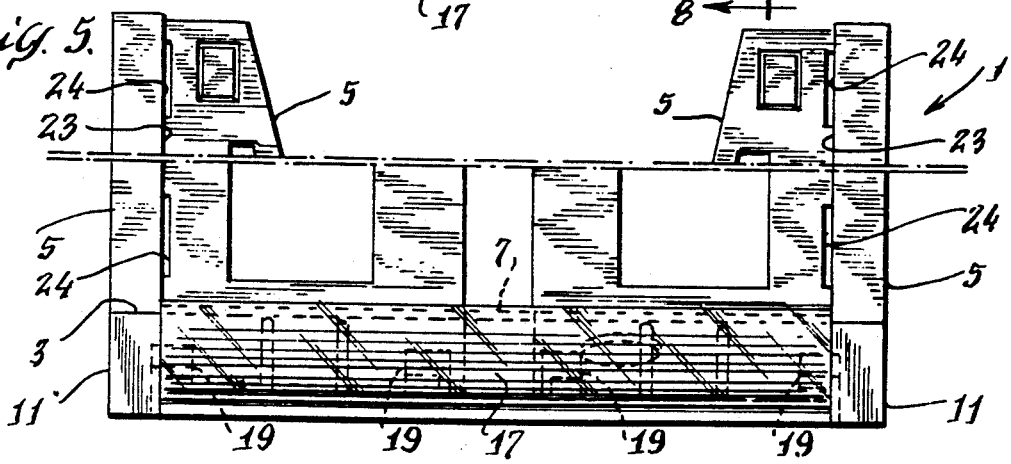
FIG. 5 is a partial plan view of my counter display when folded for shipping or storage.
Figures 6, 7:
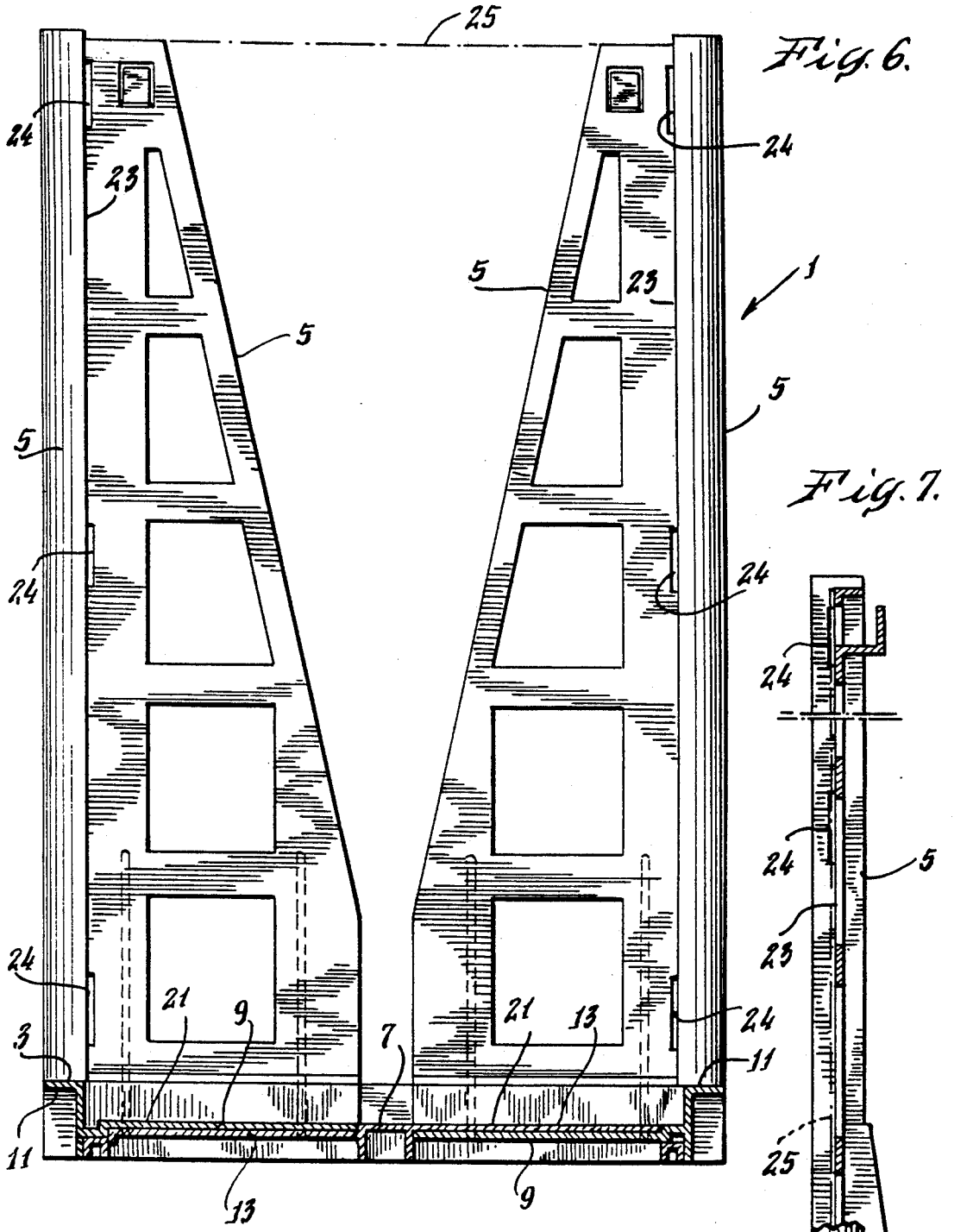
FIG. 6 is a section taken on line 6-6 of FIG. 4, being a rear elevation of the assembled stand.
FIG. 7 is a side elevation showing the base and the display back.
Figure 12:
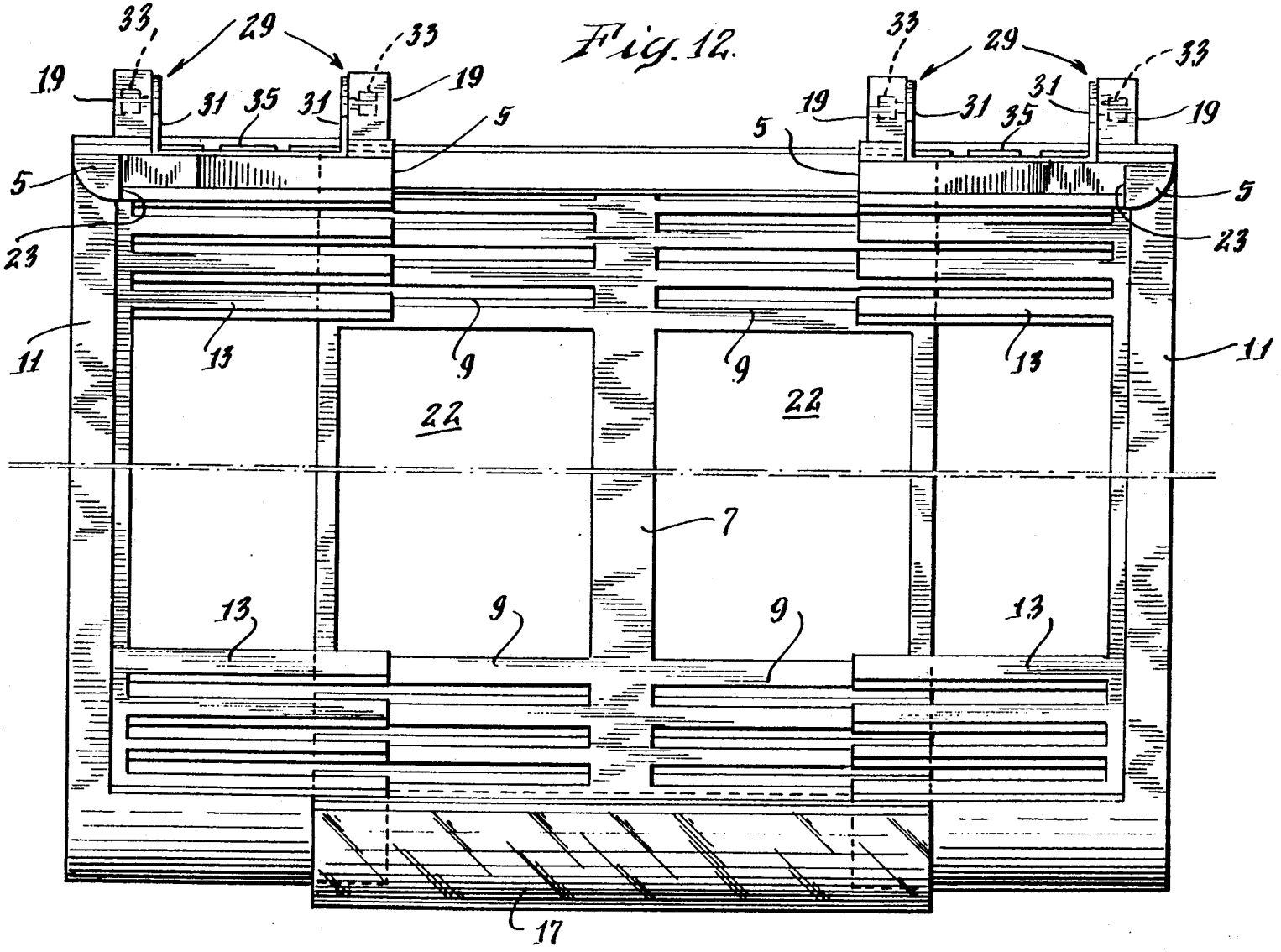
FIG. 12 is a top plan view, partially broken away, showing the base in its wide extension.
Figure 15:
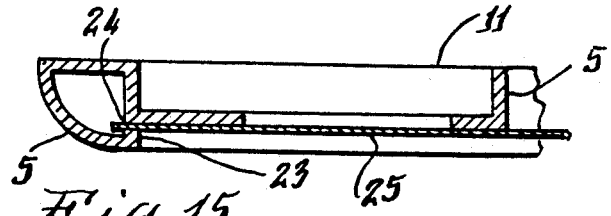
FIG. 15 is a section taken on line 15—15 of FIG. 13, showing how the display card is mounted on the back of the counter display.
Figure 14:
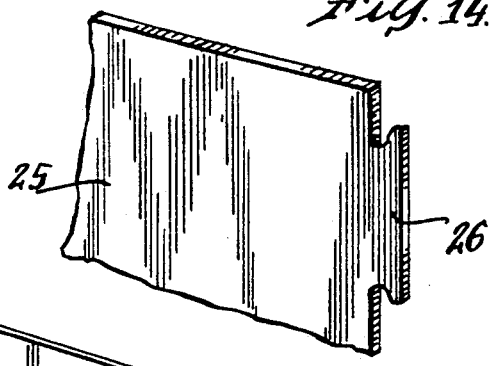
FIG. 14 is a portion of a display card, showing the lug used to secure the card to the back.
Figure 13:
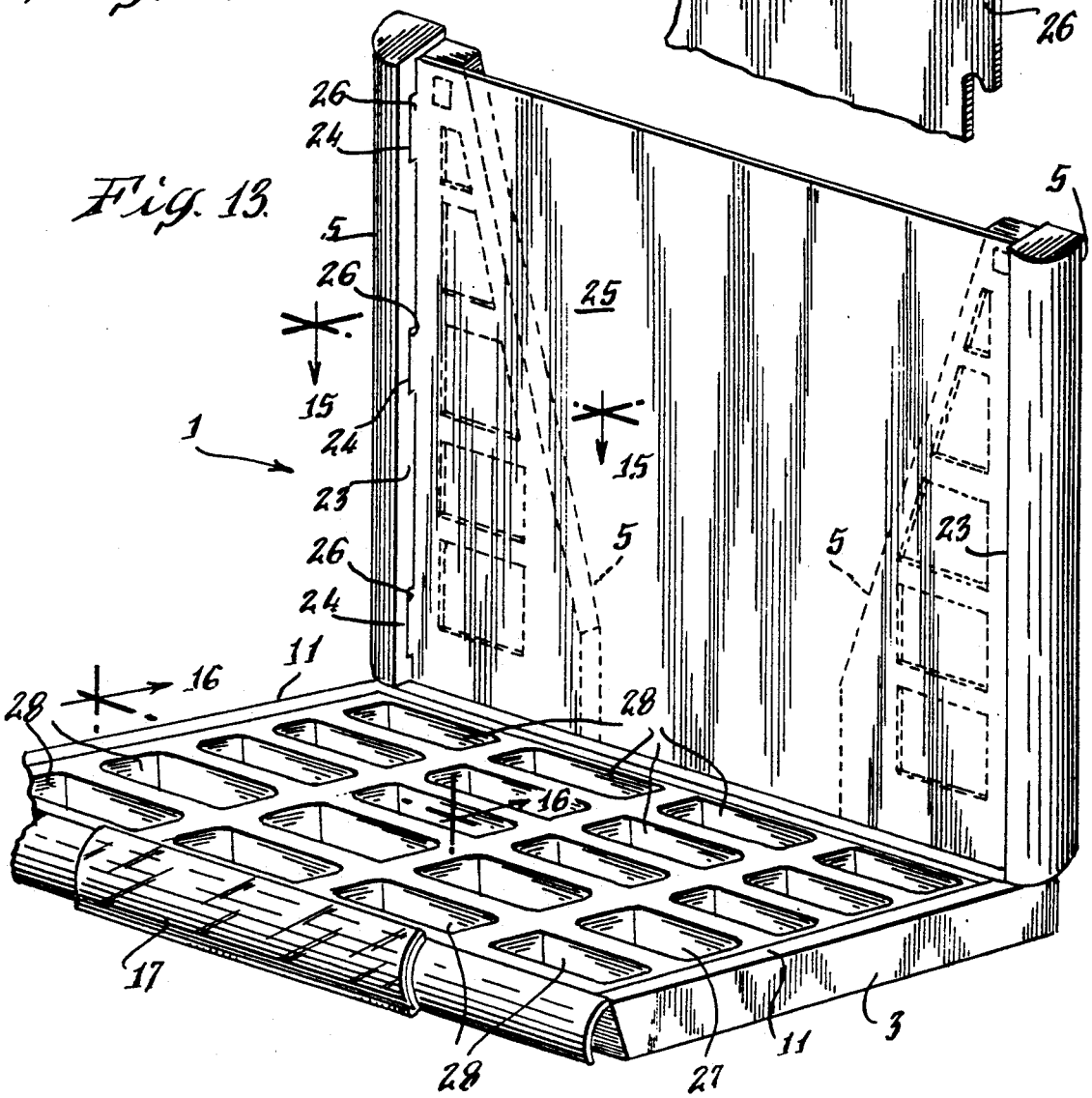
FIG. 13 is a perspective view of the display stand in use, showing the display card in position and showing one method of displaying merchandise.
Figure 16:
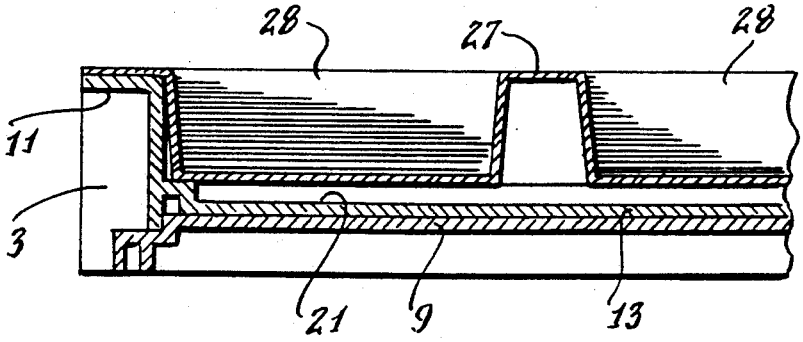
FIG. 16 is a section taken on line 16—16 of FIG. 13, showing one system for displaying merchandise.
Figure 17:
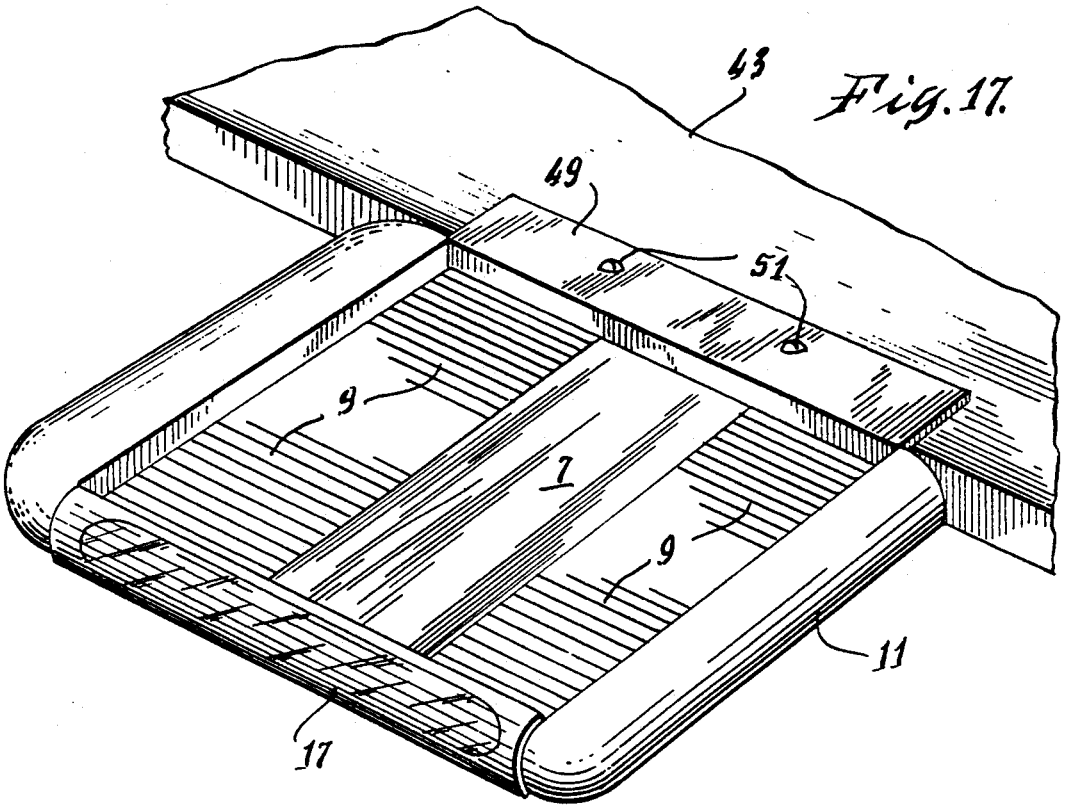
FIG. 17 is a perspective view of a modification of my invention in which the extensible base portion of the display can be used as a shelf extender.
Figure 20:
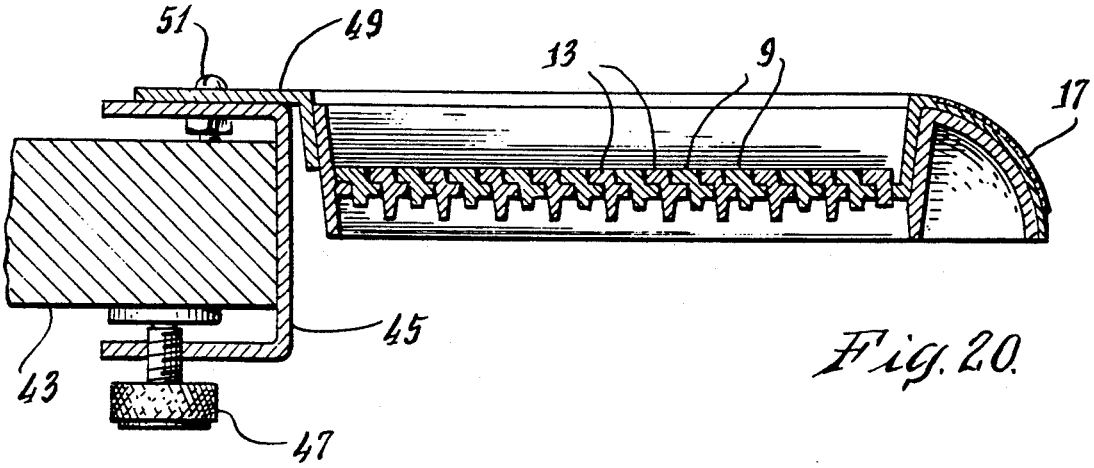
FIG. 20 is a section taken on line 20—20 of FIG. 18, showing a section across the shelf.
Figure 18:
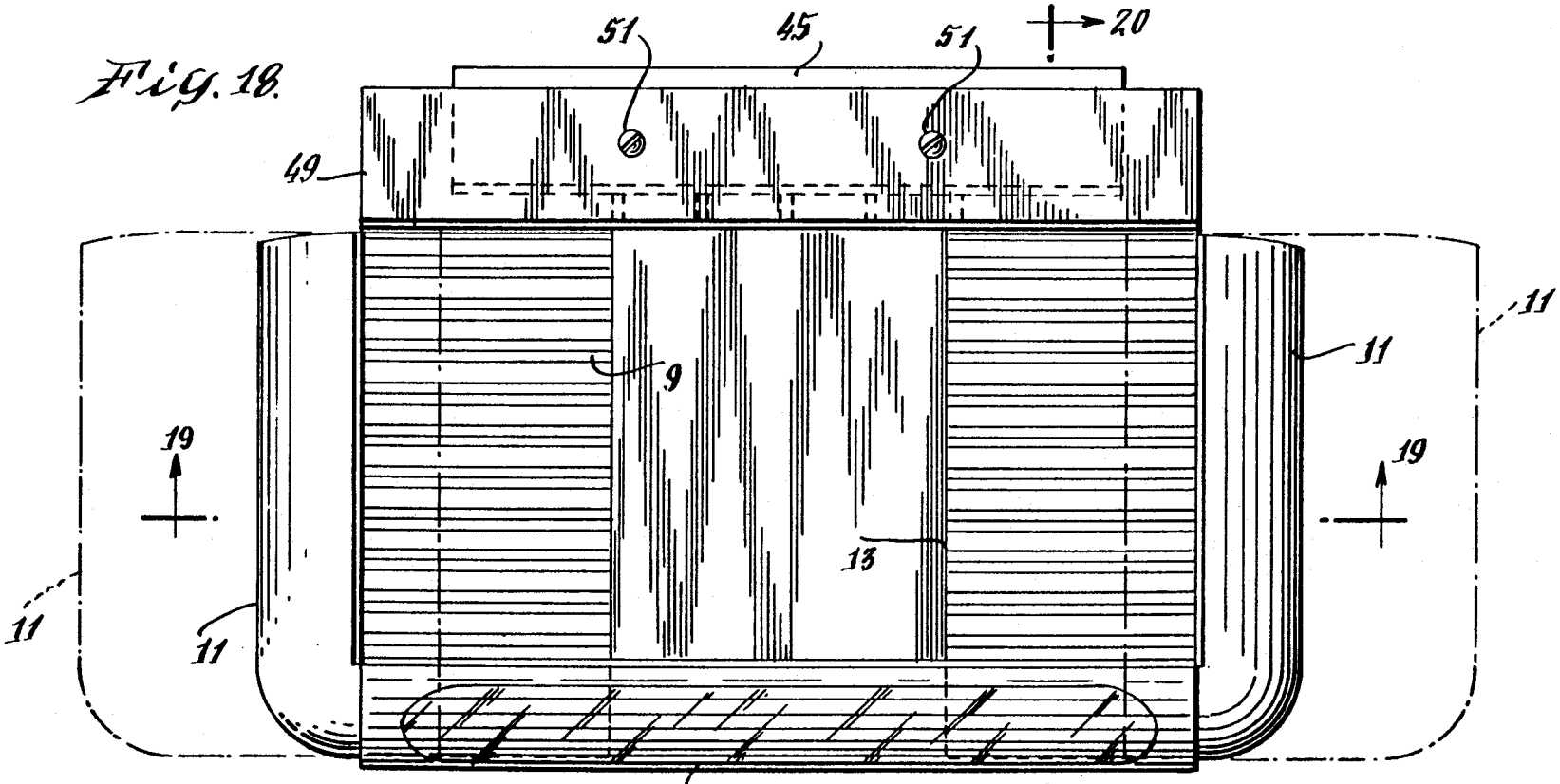
FIG. 18 is a top plan view of the modification.
Figure 19:
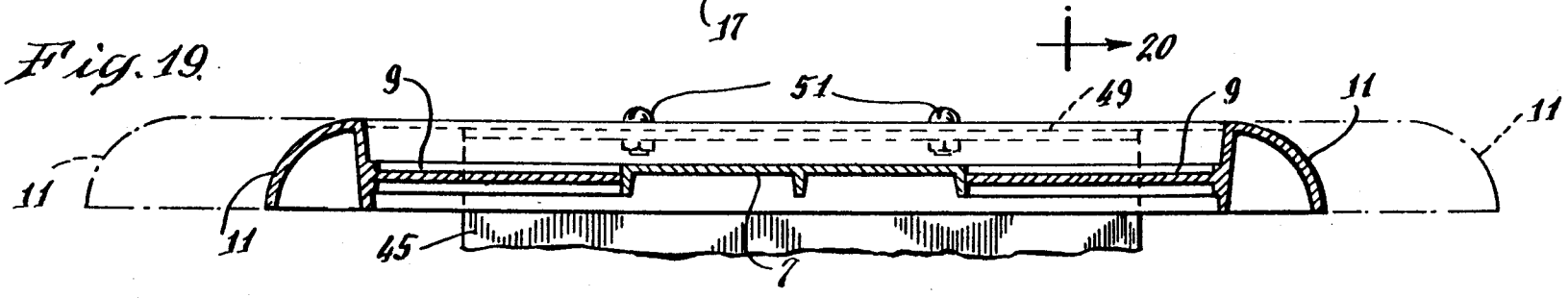
FIG. 19 is a section taken on line 19—19 of FIG. 18, showing a section of the length of the shelf extender.

FIG. 1 shows my counter display 1 in folded form, as it would be when being shipped. FIGS. 2 and 3 show it set up in its narrow form and in its expanded form, respectively.

Counter display 1 includes a base 3 and two hinged back sections 5. Base 3 is formed of a central member 7, running fore and aft, having spaced fingers 9 extending laterally out each side, and two end pieces 11, one on each side of the central member 7, the end pieces each having spaced fingers 13 extending laterally toward the central member 7. An end cap 17 may be positioned on the front edge of central member 7 for displaying price or other information. All parts can be molded of any suitable plastic material.

Fingers 9 are dimensioned to interfit in the spaces between fingers 13, and fingers 13 are dimensioned to interfit in the spaces between fingers 9. The fingers and the spaces between them are complementary to one another. This interfitting is best seen in FIGS. 4 and 8 to 10. Where they interfit, the two sets of fingers can, if desired, provide a substantially continuous upper surface. This surface is used to hold goods for display. Alternatively, the fingers may be present only adjacent the front and back of the base, to provide structural integrity for the base, with gaps 22 in the middle.

Preferably, all of the fingers have a cross-section made up of a base 15 and an upper "cantilevered" shelf 16, having what I call a Z-shaped cross-section. This cantilevering results in the shelf of one finger projecting over a portion of the base of an adjacent finger. This gives the unit more integrity, with no vertical slot between fingers that runs from the top to the bottom of the fingers. It also prevents the fingers 9 from getting out of parallelism with fingers 13 which would be undesirable because this could result in an uneven surface.

In FIG. 2 the fingers 13 of the end pieces 11 have been interfitted with fingers 9 of the central member 7 to the maximum extent, that is, end pieces 11 and fingers 13 have been pressed inwardly toward central member7 as far as they can go. This provides the minimum width counter display 1 and also provides the most uniform upper surface 21. Backs 5 are close together, so they can hold a commensurately narrow display card 25 in card holder 23.

In FIG. 3, by contrast, fingers 13 have not been interfitted as much, resulting in a wider counter display. As can be seen, backs 5 are more removed from one another, allowing for a display card 25 of similarly greater width. The counter display can, of course, be given any width intermediate the narrowest width of FIG. 2 and the widest width of FIG. 3, by suitable adjustment.

The display cards have several lugs 26 extending from their side edges. These lugs fit within slots 24 in card holders 23 to hold the display cards in position.

To the extent that the fingers are not all the way interfitted (i.e., in the wider versions), there will be gaps in surface 21 representing the spaces between adjacent fingers 9 near the central member 7 and the spaces between adjacent fingers 13 adjacent the end pieces 11 of the counter display. Accordingly, unless the goods are held on a merchandise holder 27, the shelves 16 of the fingers 9 and 13 should be dimensioned with a width (transverse of their longitudinal direction) such that the gaps are not objectionably wide. They should be narrower than the narrowest dimension of any items to be displayed.

I have found that one satisfactory dimension is to have the width of the fingers 16 about 0.100 inch ± 0.005 inch. The bases 15 of the fingers should have the same width, with the shelves cantilevered out from the bases for about half of their width. To allow for axial movement of both sets of fingers relative to one another, adjacent fingers 9 should be separated from one another by slightly more than their widths, approximately 0.009 inch more. The spacing of fingers 13 should be similar. The side surfaces of each of the fingers may be angled slightly, about 5 degrees (see FIG. 9), to provide additional clearance. This dimensioning will provide structural integrity between the central member 7 and the end pieces 11.

Accordingly, the same counter display 1 can be used in different widths at different times, depending upon the items to be displayed and the dealer's desires.

Goods can be carried by the display itself or on a merchandise holder 27, which may have separate openings or compartments 28 for the goods. If the display has been designed with gaps 22, a tray should be used.

Backs 5 are hinged on hinge mounts 19 at the back of end pieces 11, one to each end piece. These hinges are used to fold the display for shipping or storage, but are designed to lock the back sections 5 in their upright, vertical position when the counter display is assembled for use.

The structure of the hinges is best seen in FIGS. 4, 8, 10, and 11. Two hinge mounts 19 are molded along the back edges of end sections 11. Two complementary hinge brackets 31 are formed at the back of each back section 5 toward the bottom, brackets 31 each carrying a hinge pin 33 to fit within an opening 32 on each hinge mount 19. Pins 33 face away from each other and opening 32 face each other so that the pins 33 will be held in place in openings 32. This structure permits the back to swing from its shipping and storage position (FIG. 1) to its assembled position (FIGS. 2 and 3).

A spring-pressed locking arm 35, with a locking detent 37 at its lower end, extends downwardly at the lower end of back section 5. It is positioned such that detent locks with shoulder 39 on the back of end section 11. Thus, when the back is moved from its folded position under the end section to its upright, vertical position, locking detent 37 will engage with shoulder 39 and hold the back in position. When it is desired to fold the stand, detent 37 can, of course, be released by applying disengaging pressure to it. Different positions of hinge 29 can be seen in dotted outline in FIG. 11. Alternatively, the locking detent can be on the end piece and the complementary shoulder on the back.

If desired, my counter display can be made using only two end pieces 11 with the fingers 13 of the two sections being so dimensioned and spaced as to be able to interengage in a manner similar to the interengagement of fingers 9 and 13.

FIGS. 17 to 20 show a modification of my invention in which the base is used as a shelf extender for store displays. Only the base 3 is used, since it is unnecessary to have backs 5. The base has a structure like that in the previously-described unit for changing its width, including a central member 7 and end pieces 11, the same type of interengaging fingers, and preferably no gap 22. In this instance the fingers are used to vary the width of the display, so that it will be the same width as the depth of the shelf end to which it is attached. However, it does not have any of the hinge structure, but has an extension 49 extending outwardly from the back of the central section 7. This extension is bolted with bolts 51 to a U-shaped mounting bracket 45, which in turn fits about a shelf 43 and is held in place with thumb screw 47.

I claim:

1. An expandable display including a central member and at least one end piece associated with said central member, said central member including a group of central member fingers for each said end piece, said central member fingers defining central member slots therebetween, said central member fingers extending laterally toward said end piece, each said end piece having end piece fingers extending laterally towards said central member, said end piece fingers defining end piece slots therebetween, said central member fingers being slidingly mounted within said end piece slots, said end piece fingers being slidingly mounted within said central member slots, said central member fingers slidingly engaging said end piece fingers, and a back mounted on the back edge of at least one of said end pieces, said back being hinged to said end piece along said back edge, whereby the width of said display may be varied by relative sliding movement between said central member fingers and said end piece fingers.

2. An expandable merchandise display including a first base member and a second base member, a plurality of first spaced fingers on said first base member projecting towards said second base member, a plurality of second spaced fingers on said second base member projecting towards said first base member, said first spaced fingers being slidingly interfitted between said second spaced fingers, said first spaced fingers alternating with said second spaced fingers, and a back hingedly mounted along the rear edge of at least one of said base members, whereby said base members can provide a merchandise display of variable width.

3. An expandable display including a central member and at least one end piece associated with said central member, said central member including a group of central member fingers for each said end piece, said central member fingers defining central member slots therebetween, each said end piece having end piece fingers extending laterally towards said central member, said end piece fingers defining end piece slots therebetween, said central member fingers being slidingly mounted within said end piece slots, and said end piece fingers being slidingly mounted within said central member slots, and said central member fingers slidingly engaging said end piece fingers, and said central member fingers being Z-shaped with a base and a shelf and said end piece fingers being Z-shaped with a base and a shelf, whereby said central member fingers overlap said end piece fingers and said end piece fingers overlap said central member fingers, whereby the width of said display may be varied by relative sliding movement between said central member fingers and said end piece fingers.

4. An expandable display including a central member and two end pieces associated with said central member, said central member including central member fingers extending laterally from each side thereof, said central member fingers defining central member slots therebetween, said end pieces each having end piece fingers extending laterally towards said central member, said end piece fingers defining end piece slots therebetween, said central member fingers being within said end piece slots, and said end piece fingers being within said central member slots, and said central member fingers slidingly engaging said end piece fingers, each said end piece including a back portion mounted in a generally vertical position at the rear of each said end piece, and said back portions being hingedly mounted to said end pieces, whereby the width of said display may be varied by relative sliding movement between said central member fingers and said end piece fingers and said back portions may be folded under their respective said end pieces for shipment or storage of said expandable display.

5. An expandable display as set forth in claim 4 including latch means to hold said hinges in a fixed position.

6. An expandable display including a central member and two end pieces associated with said central member, said central member and said two end pieces together forming a horizontal tray section, said central member including central member fingers extending laterally from each side thereof, said central member fingers defining central member slots therebetween, said end pieces each having end piece fingers extending laterally towards said central member, said end piece fingers defining end piece slots therebetween, said central member fingers being within said end piece slots, and said end piece fingers being within said central member slots, and said central member fingers slidingly engaging said end piece fingers, said central member fingers being Z-shaped with a base and a shelf, and said end piece fingers being Z-shaped with a base and a shelf, whereby said central member fingers overlap said end piece fingers and said end piece fingers overlap said central member fingers in said horizontal section, whereby the width of said display may be varied by relative sliding movement between said central member fingers and said end piece fingers 7. An expandable display as set forth in claim 6 in which each said end piece includes a back portion mounted in a generally vertical position at the rear of each said end piece.

8. An expandable display as set forth in claim 7 in which said back portions include mounting means for holding a display card.

* * * * *